US005743060A

United States Patent [19]

Hayes et al.

[11] Patent Number: 5,743,060

[45] Date of Patent: *Apr. 28, 1998

[54] BOX TRUSS FOR LIGHTS

[76] Inventors: Jerry R. Hayes; Patrick F. Pasch, both of 6240 Columbia, Haslett, Mich. 48840

[ * ] Notice: The term of this patent shall not extend beyond the expiration date of Pat. No. 5,551,199.

[21] Appl. No.: 704,142

[22] Filed: Aug. 28, 1996

Related U.S. Application Data

[62] Division of Ser. No. 148,876, Nov. 8, 1993, Pat. No. 5,551,199.

[51] Int. Cl.[6] ..... F21L 21/14

[52] U.S. Cl. ..... 52/648.1; 52/28; 52/741.1; 362/250

[58] Field of Search ..... 52/28, 29, 646, 52/648.1, 650.1, 650.3, 651.01, 651.02, 651.03, 651.04, 651.07, 651.08, 651.09, 651.11, 652.1, 653.1, 654.1, 741.1; 362/145, 147, 249, 250, 404, 431, 432, 285, 382, 388; 248/125, 130

[56] References Cited

U.S. PATENT DOCUMENTS

| | | | |
|---|---|---|---|
| 722,635 | 3/1903 | Schneider | 52/651.09 |
| 2,936,051 | 5/1960 | Martin | 52/650.1 |
| 3,051,772 | 8/1962 | Davis . | |
| 4,459,649 | 7/1984 | Shaneour . | |
| 4,484,421 | 11/1984 | Williams et al. . | |
| 4,512,117 | 4/1985 | Lange . | |
| 4,803,606 | 2/1989 | Rotter . | |
| 4,837,665 | 6/1989 | Hoyer et al. . | |
| 4,862,336 | 8/1989 | Richardson et al. . | |
| 4,866,583 | 9/1989 | Targetti . | |
| 5,205,101 | 4/1993 | Swan et al. . | |
| 5,412,552 | 5/1995 | Fernandes . | |

FOREIGN PATENT DOCUMENTS

| | | |
|---|---|---|
| 570835 | 2/1959 | Canada . |
| 0238457 | 9/1987 | European Pat. Off. . |

*Primary Examiner*—Michael Safavi

*Attorney, Agent, or Firm*—Ian C. McLeod; Mary M. Moyne

[57] ABSTRACT

A truss assembly (10) for supporting lights (30) is described. The assembly includes a truss frame (12) with individual units (16) within which is mounted electric lights. The truss frame has end plates (34) at each end (12B) and rotatable plates (52) mounted onto each end plate by bushings (58) which are fixably mounted within the rotatable plates. Locking assemblies (64) extend through the rotating plates and into indexing holes (50) in the end plates. Support receivers (70) are attached to the rotatable plates and mount on top of support stands (74) in order to keep the truss assembly in an elevated position. In a second embodiment, the truss frames are joined together to form a longer truss assembly. Several truss assemblies are connected together by forked support stands 78 at the corners to create a truss system 80 which encloses an arena 86. The fixed bushings within the rotatable plates enable the truss frame with the electric lights to be rotated into various positions. The locking assemblies act to keep the frame in a rotated position determined by the specific placement of the indexing holes through which the locking assemblies are inserted.

14 Claims, 5 Drawing Sheets

BOX TRUSS FOR LIGHTS

This is a divisional of application Ser. No. 08/148,876 filed on Nov. 8, 1993, now U.S. Pat. No. 5,551,199.

BACKGROUND OF THE INVENTION (1) Field of the Invention

The present invention relates to a truss assembly which supports electric lights. The truss assembly with the lights is elevated above a stage in order to provide lighting for the stage and the performers during concerts and the like. In particular, the present invention relates to a truss assembly wherein the lights are mounted within the truss frame and the truss frame is able to be rotated in order to provide different angles of light for the stage and the performers.

(2) Prior Art

The prior art has described various types of lighting truss assemblies which are used in entertainment. However, none of the prior art shows a truss with the lights mounted within the truss frame at all times which is able to rotate in order to change the angle of the lights with respect to the ground surface. Illustrative of truss assemblies of the prior art are U.S. Pat. Nos. 4,459,649 to Shaneour; U.S. Pat. No. 4,484,421 to Williams et al; U.S. Pat. No. 4,512,117 to Lange; U.S. Pat. No. 4,837,665 to Hoyer et al; U.S. Pat. No. 4,862,336 to Richardson et al; U.S. Pat. No. 4,866,583 to Targetti and U.S. Pat. No. 5,205,101 to Swan et al.

Shaneour describes a pole mounted lighting system.

Williams et al describes a traveling stage comprised of trusses with I-beams resting upon the trusses and spanning the gaps between the trusses. Lighting means are located within the perimeter of the cross-section of the trusses.

Lange describes a portable proscenium theater constructed from connectable and disconnectable modular sections. The modular sections are connected together to form a framework having transverse beams connected together by longitudinal members. Lights may be supported from bars hanging from the transverse beams or from cantilevered members attached to the transverse beams.

Hoyer et al describes a modular stage light system which provides for protection of the lights during transportation of the truss. To form a protective box around the lights, the lateral members of the truss frame pivot 180° in order to extend downward on either side of the lights. Thus, during transportation the lights are positioned within the frame of the truss. Richardson et al describes a similar assembly.

Targetti describes a sectional structure for mounting lamps or spotlights in which the structural shapes are clamped together in order that the shapes are coupled mechanically and electrically. In addition, bending and joining elements may be provided between parts in order to form an angle between shapes such angled connection is both mechanical and electrical.

Swan et al describes a support system for supporting lights which is comprised of unconnected rails interconnected to directional coupling members which permits the railing assembly of the support system in any of a wide range of configurations.

OBJECTS

Therefore, it is an object of the present invention to provide a truss assembly with lights which is rotatable to allow directional adjustment of the lights. Further, it is an object of the present invention to provide a truss assembly in which the electric lights are mounted within the interior of the units of the truss frame in order to protect the electric lights during transportation. Still further, it is an object of the present invention to provide a truss which can be connected with other similar trusses to provide a truss system for lighting an arena. Still further, it is an object of the present invention to provide a truss which is supported on support stands in order to be elevated above the ground surface. Further, it is an object of the present invention to provide a truss which can be rotated on the support stand. Still further, it is an object of the present invention to provide a truss assembly in which the electric lights are mounted within the truss frame and can be rotated within the truss frame about the mounting assembly. Still further, it is an object of the present invention to provide a truss assembly in which the mounting bolt attaching the electric light to the mounting bracket is abutted against a diagonal brace to prevent rotation of the mounting bolt to enable easier mounting of the electric light. Finally, it is an object of the present invention to provide a truss assembly having lights which is easy to assemble and lightweight.

DETAILED DESCRIPTION OF THE PREFERRED EMBODIMENTS

Figure 1:
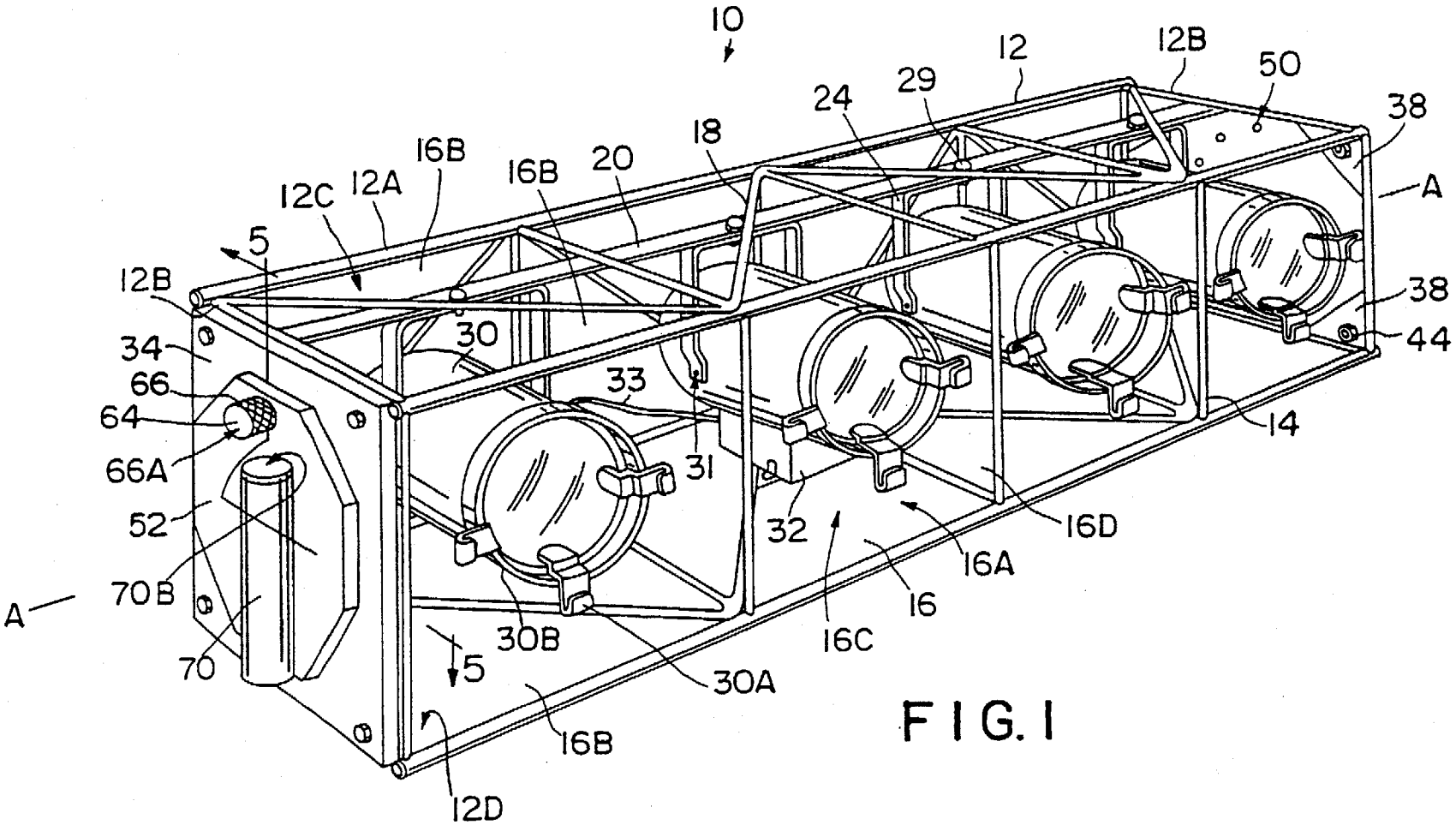
FIG. 1 is a front perspective view of the truss assembly 10 showing the corner posts 12A, the rods 14, the diagonal brace 18 and the electric lights 30 mounted within the units 16 of the truss frame 12.

The present invention relates to a truss assembly for supporting electric lights which comprises: a truss including: first rods extending parallel to a longitudinal axis of the truss each having spaced apart first and second ends perpendicular to the longitudinal axis of the truss so as to define a rectangular cross-section perpendicular to the longitudinal axis with four sides; second rods having spaced apart ends and extending between and perpendicular to two of the first rods to form a plurality of side-by-side openings along the length of the first rods wherein the openings are in a plane parallel to the longitudinal axis of the truss and provide a front side of the truss along one of the sides; a plurality of third rods extending diagonally between two of the first rods and the ends of the second rods across each of the remaining sides within planes parallel to the longitudinal axis of the truss and defined by each of the remaining sides of the truss; a pair of end plate means mounted on the first end and the second end of the first rods; a pair of rotatable plate means with two spaced apart sides mounted on the end plate means so as to rotate parallel to the longitudinal axis; a pair of disengageable locking means mounted between each of the rotatable plate means and the end plate means to lock the truss in a desired position with the front side of the truss facing a desired position; and a pair of support receiving means mounted on the rotatable plate means on a side opposite the mounted end plate means for supporting the truss in an elevated position with a support means.

Furthermore, the present invention relates to a segment of a truss for supporting electric lights which comprises: first rods extending parallel to a longitudinal axis of the truss each having spaced apart first and second ends perpendicular to the longitudinal axis of the truss so as to define a rectangular cross-section perpendicular to the longitudinal axis with four sides; second rods having spaced apart ends and extending between and perpendicular to two of the first rods to form a plurality of side-by-side openings along the length of the first rods wherein the openings are in a plane parallel to the longitudinal axis of the truss and provide a front side of the truss along one of the sides; a plurality of third rods extending diagonally between two of the first rods and the ends of the second rods across each of the remaining sides within planes parallel to the longitudinal axis of the truss and defined by each of the remaining sides of the truss; and a pair of end plate means mounted on the first end and the second end of the first rods; a pair of rotatable plate means with two spaced apart sides mounted on the plate means so as to rotate parallel to the longitudinal axis; a pair of disengageable locking means mounted between each of the rotatable plate means and the end plate means to lock the truss in a desired position with the front side of the truss facing a desired position; a pair of support receiving means mounted on the rotatable plate means on a side opposite the mounted end plate means for supporting the truss in an elevated position with a support means; and a fourth rod mounted parallel to the longitudinal axis in a plane along an uppermost one of the sides of the truss and wherein fastening means is provided at an intersection of the third rod and the fourth rod for securing lights inside of the segment adjacent each of the side-by-side openings in the front side of the truss.

Still further, the present invention relates to a method for lighting an area with electric lights which comprises: providing a truss assembly including: a truss having first rods extending parallel to a longitudinal axis of the truss each having spaced apart first and second ends perpendicular to the longitudinal axis of the truss so as to define a rectangular cross-section perpendicular to the longitudinal axis with four sides; second rods having spaced apart ends and extending between and perpendicular to two of the first rods to form a plurality of side-by-side openings along the length of the first rods wherein the openings are in a plane parallel to the longitudinal axis of the truss and provide a front side of the truss along one of the sides; a plurality of third rods extending diagonally between two of the first rods and the ends of the second rods across each of the remaining sides within planes parallel to the longitudinal axis of the truss and defined by each of the remaining sides of the truss; a pair of end plate means mounted adjacent on the first end and the second end of the first rods; a pair of rotatable plate means with two spaced apart sides mounted on the plate means so as to rotate parallel to the longitudinal axis; a pair of disengageable locking means mounted between each of the rotatable plates and the end plate means to lock the truss in a desired position with the front side of the truss facing a desired position; a pair of support receiving means mounted on the rotatable plate means on a side opposite the mounted end plate means for supporting the truss in an elevated position with a support means; and a fourth rod mounted parallel to the longitudinal axis in a plane along an uppermost one of the sides of the truss and wherein fastening means is provided at an intersection of the third rod and the fourth rod for securing lights inside of the truss adjacent each of the side-by-side openings of the truss; mounting the truss assembly on a support means at each of the support receiving means; and positioning the lights on the truss assembly so as to be directed at the area.

The head of the bolt which fastens the electric light to the fourth rod engages the third rod to prevent rotation of the bolt while attaching the nut. The end plate has a series of holes through which the pin of the locking assembly extends such as to maintain the truss in a rotated position with respect to the ground surface. The locking assembly and the series of holes enables the truss to be adjusted by rotation on the rotatable plates.

FIGS. 1 to 5 show the preferred embodiment of the truss assembly 10 of the present invention. The truss assembly 10 is comprised of a truss frame 12 having units 16, electric lights 30 mounted within each unit 16 and an end plate 34, a rotating plate 52 and a support receiver 70 at ends 12B of the truss frame 12. The truss frame 12 is constructed of four corner posts 12A which extend parallel to the longitudinal axis A—A of the frame 12 to form a top side 12C and a bottom side 12D of the frame 12 extending between opposed ends 12B of the frame 12. Preferably the top side 12C and the bottom side 12D of the truss frame 12 are similar in shape and size such that the truss frame 12 has a rectangular cross-section about the longitudinal axis A—A. The cylindrical corner posts 12A are preferably hollow and constructed of aluminum in order to decrease the overall weight of the assembly 10.

Rods 14 are positioned along the frame 12 perpendicular to the axis A—A of the truss frame 12 and extend between two of the cylindrical corner posts 12A of the rectangular truss frame 12. The rods 14 section the truss frame 12 into individual units 16 having three exterior sides 16B, a front opening 16C enclosing an interior 16A (FIG. 1). The three sides 16B and the front opening 16C have the same dimensions. Preferably, each truss assembly 10 contains four (4) units 16 having a height of 18 inches, a depth of 18 inches and a width of 15 inches. Correspondingly, each truss assembly 10 having four (4) units 16 has a height of 18 inches and a length of 5 ft.

Diagonal braces 18 extend diagonally across each of the three (3) sides 16B of each unit 16. The diagonal braces are mounted such as to extend between the two cylindrical corner posts 12A and between the two rods 14 which form each of the sides 16B of the unit 16. The diagonal braces 18 extend across only the three exterior sides 16B of the unit 16 such that the front opening 16C of each unit 16 is completely open. The front opening 16C of each unit 16 allows for the installation of the electric light 30 (to be described in detail hereinafter) within the unit 16. The opening 16C also enables the electric light 30 to shine undisturbed through the truss frame 12 and onto the stage (not shown). The diagonal braces 18 increase the structural strength of the units 16 thus, allowing the truss assembly 10 to be constructed of light-weight material such as aluminum while retaining the strength necessary to safely support the electric lights 30. The diagonal braces 18 and the rods 14 are preferably constructed of aluminum and are welded at their ends onto the cylindrical corner posts 12A.

Internal braces (not shown) can be mounted diagonally between the units 16 to provide additional strength and structural integrity to the truss frame 12. The internal braces are similar to the diagonal braces 18 and are mounted such as to extend between the two cylindrical corner posts 12A and between the two rods 14 which form the common sides 16D shared between two units 16. In the preferred embodiment, the center internal brace (not shown) extends from the top side 12C of the truss frame 12 adjacent the front openings 16C of the units 16 downward to the bottom side 12D of the truss frame 12. The remaining internal braces are mounted in the opposite direction and extend upward from the bottom side 12D of the truss frame 12 adjacent the front openings 16C of the units 16 to the top side 12C of the truss frame 12 opposite the front openings 16C. The center internal brace prevents separation of corner posts 12A forming the top side 12C from the corner posts 12A forming the bottom side 12D of the truss frame 12. The center internal brace is important when additional objects such as outer lights (not shown) are mounted onto the truss frame 12. The remaining internal braces provide structural strength to prevent deflection of the truss frame 12 downward which could occur when the truss frame 12 is comprised of more than four units 16. The structural strength of the truss frame 12 can also be increased by increasing the thickness of the tubing used for the corner posts 12A and by constructing the corner posts 12A from a stronger material. These additions however increase the weight of the truss assembly 10.

A mounting strip 20 is mounted adjacent to the top side 12C of the truss frame 12 parallel to the axis A—A of the truss frame 12. The mounting strip 20 extends between the ends 12B of the truss frame 12 and is mounted beneath the rods 14 and the diagonal braces 18 towards the interior 16A of the units 16 (FIG. 1). Preferably, the mounting strip 20 is constructed of aluminum and is welded onto the diagonal braces 18 and the rods 14. The mounting strip 20 has a series of holes 22 extending perpendicular to the axis of the truss frame 12 and spaced apart along the length of the mounting strip 20 such that one hole 22 is centered over each of the units 16 of the truss frame 12.

Figure 2:
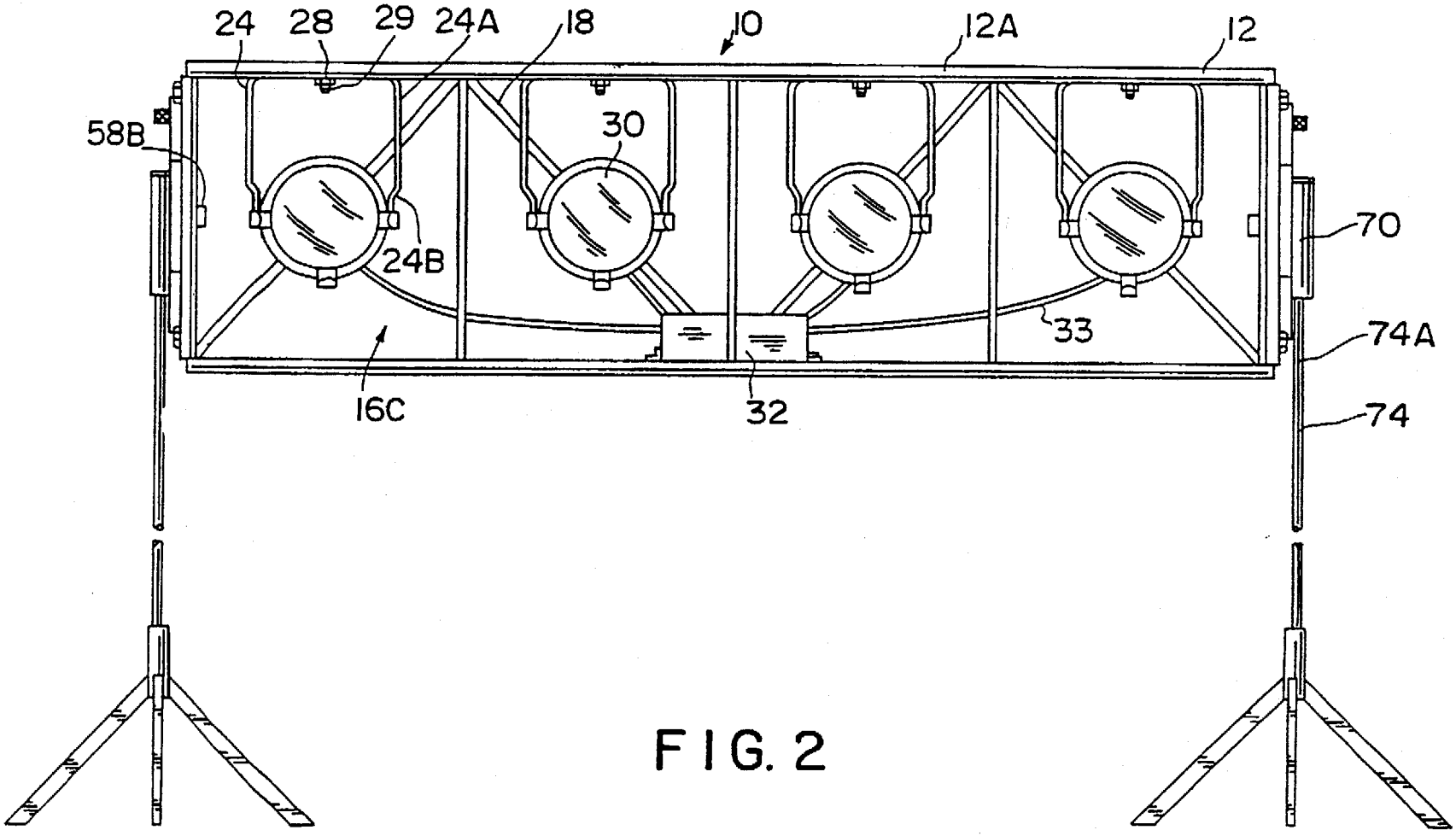
FIG. 2 is a front view of the truss assembly 10 with the support stands 74 showing the electric lights 30 and the dimmer control box 32.
Figure 3:
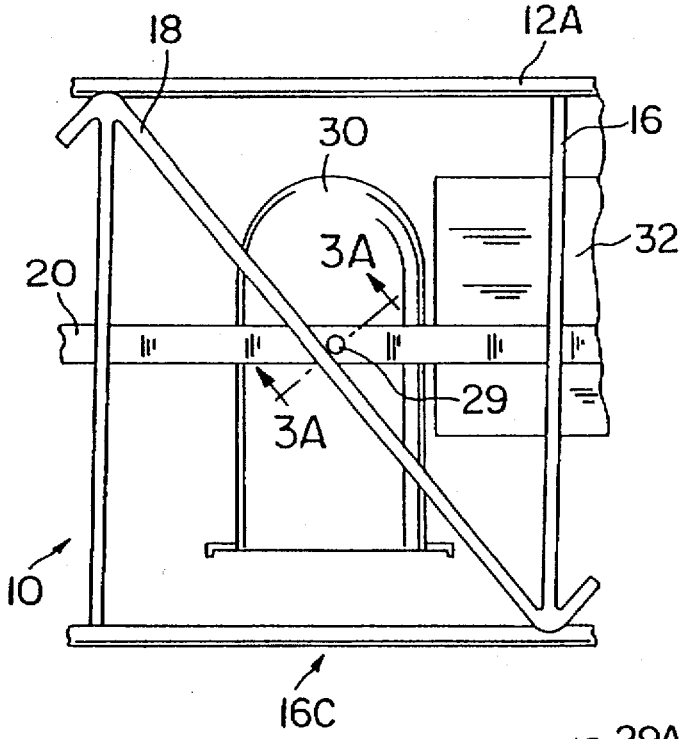
FIG. 3 is a top partial view of one unit 16 of the truss assembly 10 showing the mounting bolt 29, the electric light 30, the mounting bracket 24 and the diagonal brace 18.
Figure 3A:
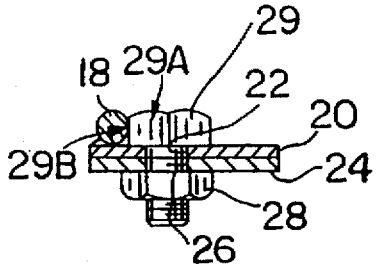
FIG. 3A is a cross-sectional view of FIG. 3 along the line 3A—3A showing the mounting bolt 29 mounted through the mounting strip 20 and the lighting bracket 24 with the head 29A of the mounting bolt 29 abutted against the diagonal brace 18.

A lighting bracket 24 is mounted to the mounting strip 20 in each unit 16 of the truss frame 12 (FIG. 1). The lighting bracket 24 is U-shaped with the legs 24A of the bracket 24 extending downward from the mounting strip 20 into the interior 16A of the units 16 and toward the bottom side 12D of the truss frame 12 (FIG. 2). Preferably, the lighting bracket 24 is similar to those used in conventional lighting trusses. The lighting bracket 24 has an aperture 26 midway between the ends 24B of the legs 24A of the bracket 24 and is attached onto the mounting strip 20 by a mounting nut 28 and a mounting bolt 29 which is inserted through the hole 22 in the mounting strip 20 and the aperture 26 in the lighting bracket 24 (FIG. 3A). In the preferred embodiment, as shown in FIGS. 3 and 3A, the mounting bolt 29 has a head 29A having eight (8) sides 29B and is inserted through the mounting strip 20 such that one of the sides 29B of the head 29A of the bolt 29 is abutted against the diagonal brace 18. The position of the head 29A of the bolt 29 against the diagonal brace 18 prevents the head 29A of the bolt 29 from rotating which allows for easier attachment of the mounting nut 28 onto the bolt 29 (FIG. 3A). Thus, the lighting bracket 24 and consequently, the electric light 30 are easier to mount within the truss frame 12. The electric light 30 is mounted between the legs 24A of the mounting bracket 24 adjacent the end 24B of the legs 24A of the bracket 24. The electric light 30 is secured within the legs 24A of the bracket 24 by rivets 31 on either side of the light 30 which allow the light 30 to pivot within the bracket 24 such as to increase the variety of angles achievable by the lights 30 (FIG. 1). The electric lights 30 have filter clamps 30A which are mounted adjacent the front 30B of the light 30 (FIG. 1). The filter clamps 30A are preferably permanently and fixably mounted onto the light 30 and enable filters (not shown) to be mounted over the front 30B of the light 30. The filters easily slide into the clamps 30A and are easily removed and replaced. Each light 30 has a separate filter thus, the user is able to change the intensity or color of the light shining from each electric light 30 which adds to the versatility of the truss assembly 10. Preferably, the electric lights 30 are similar to those used in conventional lighting trusses. In the preferred embodiment there are between about four (4) and seven (7) lights 30 per truss assembly 10. The additional electric lights (not shown) are positioned between the units 16 of the truss frame 12. Furthermore, other objects (not shown) such as outer lights can be mounted onto the truss frame 12. Preferably the added objects are mounted on the corner posts 12A of the truss from 12 and do not interfere with the rotation of the truss assembly 10.

A dimmer control box 32 is mounted within the truss frame 12 adjacent sides 16B of the units 16 on the bottom side 12D of the truss frame 12 (FIG. 2). The dimmer box 32 is centrally located between the ends 12B of the truss frame 12 in order to minimize the distance between the dimmer box 32 and the electric lights 30 adjacent the ends 12B of the frame 12 and thus, reduce the amount of electrical wiring 33 used to connect the box 32 to the lights 30 (FIG. 2). Preferably, each truss assembly 10 having four units 16 and four electric lights 30 is controlled by a single dimmer box 32. The dimmer control box 32 controls the brightness of the lights 30 and is the electrical connection between the electric lights 30 and the electrical source (not shown) located at the ground surface (not shown).

Figure 4:
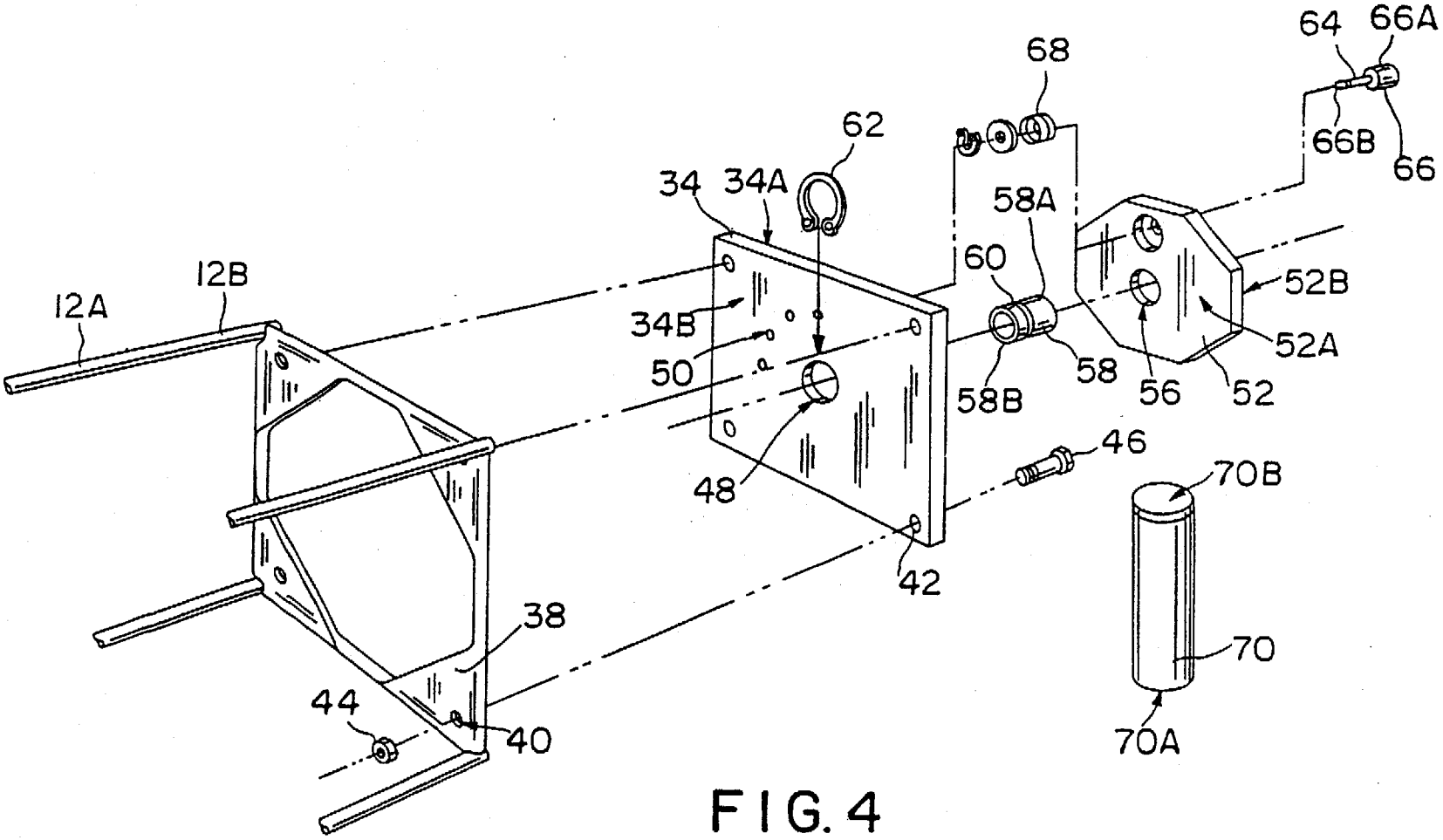
FIG. 4 is an exploded view of one end 12B of the truss frame 12 showing the rotating plate 52, the end plate 34, the locking pin 66, the bushing 58, the indexing holes 50 and the support receiver 70.

Corner plates or gussets 38 having three sides 38A are mounted adjacent the ends 12B of the truss frame 12. The corner plates 38 are triangular in shape and are positioned such that two of the sides 38A of the corner plate 38 are adjacent to the rods 14 which extend between the cylindrical corner posts 12A to form the ends 12B of the truss frame 12. Each of the corner plates 38 have an attachment hole 40 which extends parallel to the axis A—A of the truss assembly 10 (FIG. 4). Preferably, there are eight corner plates 38 per truss assembly 10, one mounted in each of the four corners of the ends 12B of the truss frame 12.

The end plates 34 are mounted to the corner plates 38 at both the ends 12B of the truss frame 12. The end plates 34 have an outer side 34A and an inner side 34B and are preferably the same shape as the truss frame 12. Thus, the end plates 34 are preferably square. The end plates 34 have four holes 42 in approximately each corner of the end plate 34. The end plates 34 are mounted onto the truss frame 12 such that the inner side 34B of the plate 34 is adjacent the corner plates 38 and such that each hole 42 of the end plate 34 is aligned with the attachment hole 40 of the corner plates 38. An attachment bolt 46 is inserted through the hole 42 in the end plate 34 and the hole 40 in the corner plate 38 to mount the end plates 34 onto the end 12B of the truss frame 12 (FIG. 4). An attachment nut 44 is placed onto the bolt 46 in order to secure the end plates 34 to the truss frame 12. In the preferred embodiment, the bolt 46 is mounted through the holes 42 and 40 such that the nut 44 is adjacent the corner plate 38.

The end plates 34 have a first central opening 48 extending parallel to the axis A—A of the truss frame 12 for mounting the rotatable plates 52 (to be described in detail hereinafter) onto the end plates 34 and thus, the ends 12B of the truss frame 12. A set of indexing holes 50 are located in each of the end plates 34 spaced apart from the central opening 48 toward the top side 12C of the truss frame 12 and extending in an arc around the central opening 48 (FIG. 4). Preferably, the indexing holes 50 extend along only one quarter of the end plate 34 and are spaced 30° apart. The number and spacing of the indexing holes 50 determines the number and variety of permanent angles capable by rotating the truss frame 12. The indexing holes 50 enable a locking pin 66 (to be described in detail hereinafter) to secure the truss frame 12 in any chosen position depending on the indexing hole 50 being used.

The rotatable plates 52 have an inner side 52A and an outer side 52B and are secured onto the end plates 34 such that the inner side 52A of the rotatable plate 52 is adjacent the outer side 34A of the end plate 34 opposite the corner plates 38 and the truss frame 12. As shown in FIG. 4, each rotatable plate 52 has a second central opening 56 which extends perpendicular to the axis A—A of the truss frame 12 and which has a diameter similar to the diameter of the first central opening 48 of the end plates 34. The rotatable plates 52 are secured to the end plates 34 by means of bushings 58 (to be described in detail hereinafter). The rotatable plates 52 allow the truss frame 12 to be rotated such that the electric lights 30 remain shining through the front opening 16C of each unit 16 while the light is projected in a multitude of directions and angles with respect to the ground surface. The rotatable plates 52 are smaller in size than the end plates 34 such that the rotatable plates 52 are able to rotate around the axis A—A of the truss frame 12 without any portion of the rotatable plate 52 extending beyond the perimeter of the end plate 34 (FIG. 1). The shape of the rotatable plates 52 is preferably octagonal although other shapes such as circular or square can also be used.

Figure 5:
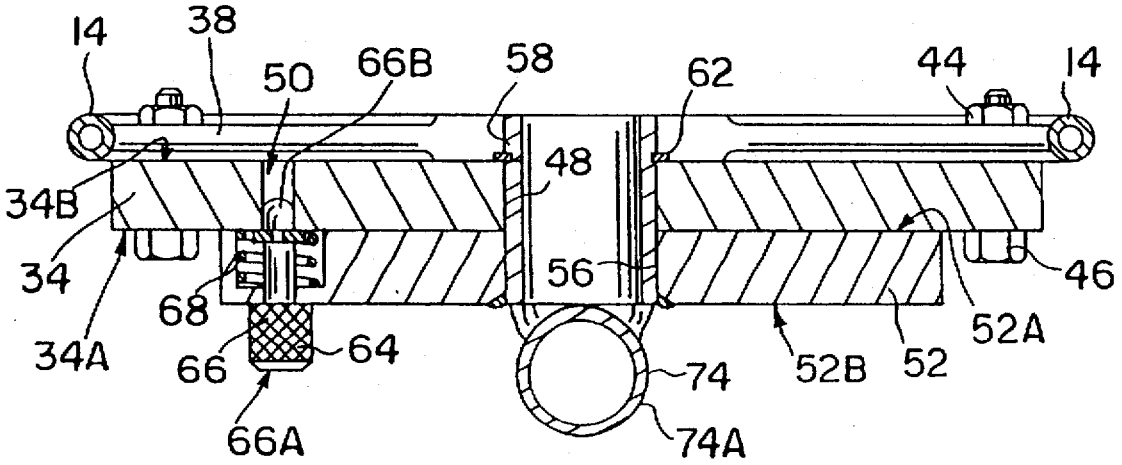
FIG. 5 is a cross-sectional view of FIG. 1 along the line 5—5 showing the rotating plate 52, the end plate 34, the bushing 58, the support receiver 70 and the locking pin assembly 64.

The bushing 58 has a first end 58A and a second end 58B which extend into the second central opening 56 of the rotatable plate 52 and the first central opening 48 of the end plate 34 (FIG. 5), respectively. The bushing 58 preferably has an outer diameter similar in size to the diameter of the first central opening 48 of the end plate 34, and the second central opening 56 of the rotatable plate 52. The bushing 58 is of a size such as to easily rotate within the first central opening 48 of the end plate 34 without extraneous side-by-side motion. As shown in FIG. 5, the bushing 58 is fixably mounted within the second central opening 56 of the rotatable plates 52 such that the bushing 58 does not rotate with respect to the rotatable plates 52. Preferably, the bushings 58 are welded into the second central openings 56. The bushing 58 enables the rotatable plate 52 to remain stationary while the truss frame 12 including the end plates 34 is rotated around the axis A—A of the truss frame 12. The first end 58A of the bushing 58 is flush with the outer side 52B of the rotatable plate 52 such that the support receiver 70 (to be described in detail hereinafter) is mounted on the outer side 52B of the rotatable plate 52 over the second central opening 56 with the bushing 58 mounted within (FIG. 5). The second end 58B of the bushing 58 extends beyond the inner side 34B of the end plate 34 and has a groove 60 adjacent the second end 58B of the bushing 58 which extends beyond the end plate 34. A C-spring or ring 62 is inserted into the groove 60 in each bushing 58 and acts to secure the truss frame 12 onto the rotating plates 52 (FIGS. 4 and 5) by preventing the end plates 34 from slipping off of the bushing 58. The bushings 58 are preferably constructed of steel in order to withstand the weight of the truss assembly 10 and to reduce damage to the bushing 58 during rotation of the truss assembly 10.

A locking assembly 64 is mounted through each of the rotatable plates 52 parallel to the axis A—A of the truss frame 12 (FIG. 5). The locking assembly 64 is comprised of a locking pin 66 and a coil spring 68. The locking pin 66 is mounted through the rotatable plate 52 above the support receiver 70 such that the head 66A of the pin 66 is adjacent the outer side 52B of the rotatable plate 52 and the end 66B of the pin 66 extends into one of the indexing holes 50 in the end plate 34. The coil spring 68 acts to bias the pin 66 into the indexing hole 50 of the end plate 34 when the locking pin 66 is in the locked position. The locking assemblies 64 enable the truss assembly 10 to be locked into a rotated position as determined by the particular location of the indexing holes 50 in the end plates 34 through which the end 66B of the locking pin 66 is inserted. Preferably, the indexing holes 50 chosen in each end plate 34 are similarly spaced around the axis such that the truss frame 12 is evenly rotated at both ends 12B in order to eliminate possible twisting of the frame 12.

A support receiver 70 is mounted onto the outer side 52B of each rotatable plate 52 of the truss assembly 10 perpendicular to the axis A—A of the truss frame 12. The support receivers 70 are secured onto the rotatable plates 52 over the second central openings 56 such that the support receivers 70 prevent the first ends 58A of the bushings 58 from extending beyond the outer sides 52B of the rotatable plates 52. The support receivers 70 are preferably a cylindrical hollow tube having an opening 70A at one end extending upward toward the top side 12C of the truss frame 12 perpendicular to the axis A—A and ending at a closed top 70B at the other end. In the preferred embodiment, a brace (not shown) is welded onto the closed top 70B of each receiver 70 to prevent the shaft 74A of the support stand 74 (to be described in detail hereinafter) from penetrating the closed top 70B of the receiver 70. Thus, the brace adds strength to the top 70B of the support receiver 70 and assists in keeping the truss assembly 10 in the elevated position.

As shown in FIG. 2, a support stand 74 is mounted into the openings 70A of the support receivers 70 at either end 12B of the truss frame 12 to support the truss assembly 10 in the elevated position. Preferably, the stands 74 are similar to those conventionally used and have a central shaft 74A with three legs in a tripod position. The shaft 74A of the stand 74, preferably has a circular cross-section with an outer diameter similar to the inner diameter of the receiver 70. The receivers 70 are of a length such as to provide ample support for the shafts 74A of the support stands 74 such that the shafts 74A do not slip out of the receivers 70. The length of the shafts 74A and thus the height of the truss assembly 10 with respect to the ground surface, can be varied depending upon the particular use of the truss assembly 10.

Figure 6:
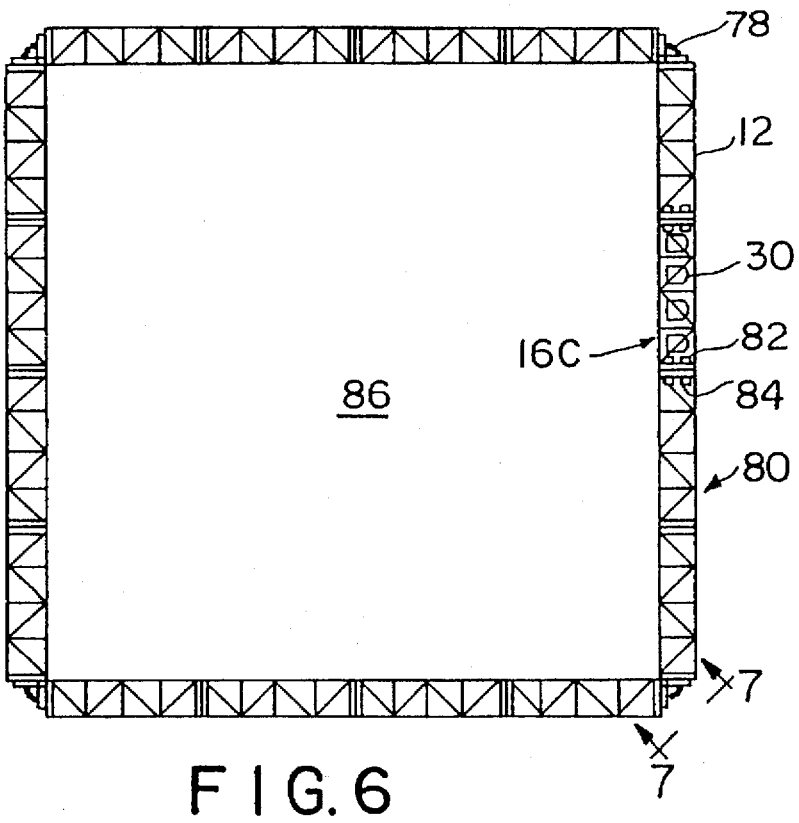
FIG. 6 is a schematic top view of a truss system 80 showing several adjacent truss frames 12 connected together to form a lighted arena 86.
Figure 7:
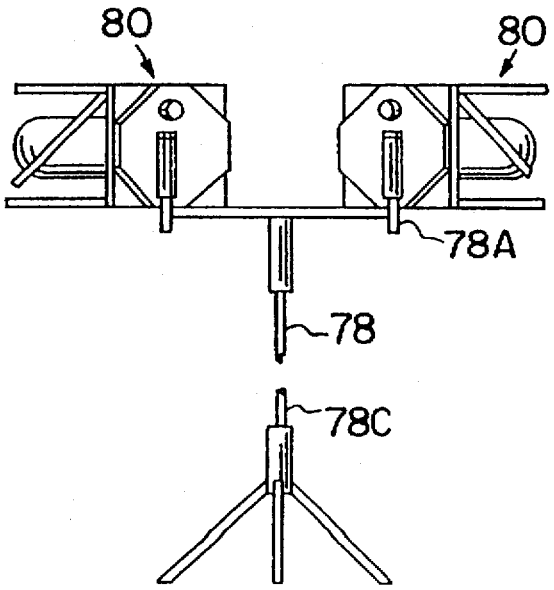
FIG. 7 is a corner view of FIG. 6 adjacent the line 7—7 showing the two truss frames 12 connected together to form a corner by the forked support stand 78.

In an alternate embodiment, as seen in FIGS. 6 and 7, several truss frames 12 are connected together in order to increase the length of the truss assembly 10. The truss frames 12 are connected together by securing nut 82 and a securing bolt 84 which extend through the holes 40 in the corner plates 38 of the adjacent truss frames 12 (FIG. 6). The adjacent truss frames 12 are connected together such that the front openings 16C of the units 16 of all the truss frames 12 are facing in the same direction. A forked support stand 78 having two tines 78A at the top of the shaft 78C of the forked support stand 78 is used to connect two truss assemblies 10 together. In the alternate embodiment as shown in FIG. 6, four truss assemblies 10 are connected together with a forked support stand 78 at each connection of two assemblies 10. Preferably, the truss frames 12 which are positioned between two forked support stands 78 rotate together. Each truss assembly 10 is mounted onto one tine 78A of the forked stand 78 such that the two truss assemblies 10 form a corner (FIG. 7). FIG. 6 shows the connection of several truss assemblies 10 to form a truss system 80 preferably such as to enclose an arena 86.

IN USE

In use, the lighting brackets 24 with the electric lights 30 are installed within the interior 16A of the units 16 of the truss frame 12. The electric lights 30 are then electrically connected to the dimmer control box 32. Next, the receiver supports 74 of the truss assembly 10 are mounted over the shafts 74A of the support stands 74. In the preferred embodiment, a single truss frame 12 having four units 16 comprises the truss assembly 10 and is positioned with a support stand 74 at each end 12B of the truss frame 12 (FIG. 2). The truss assembly 10 is then raised to an elevated position preferably above the stage and the performers (not shown). Each unit 16 has a single electric light 30 which, in the normal position, is horizontal to the ground surface such that the light 30 is shining through the front opening 16C of the unit 16. To adjust the angle of light relative to the ground surface, either the electric light 30 is pivoted on the lighting bracket 24 or the truss frame 12 is rotated on the support stands 74. To move the electric lights 30 individually, the electric lights 30 are pivoted on the rivets 31 within the legs 24A of the lighting brackets 24. When in the elevated position, this positioning of the lights 30 is accomplished either manually using an extension (not shown) or mechanically with a mechanical rotation device (not shown) which is controlled electronically from the ground surface. The amount of actual rotation of the electric lights 30 is limited by the electrical wires 33 connecting the light 30 to the dimmer control box 32 and by the sides 16B of the units 16. The effectiveness of moving the individual lights 30 is limited in that when the light 30 rotates beyond 90° in either direction, the light 30 is no longer shining through the front opening 16C of the unit 16. Thus, the diagonal braces 18 present in remaining sides 16A of the unit 16 or alternately, the cylindrical corner posts 12A, interfere with the beam of light which detracts from the effect of the lighting. To allow uninterrupted light in any direction, the truss frame 12 and the end plates 34 are rotated on the support stands 74 around the axis A—A of the truss frame 12. To rotate the truss frame 12, the heads 66A of the locking pins 66 are pulled outward parallel to the axis A—A of the truss frame 12 away from the outer sides 52B of the rotatable plates 52 such that the locking pins 66 no longer extend into the indexing holes 50 in the end plates 34 (FIG. 5). The truss frame 12 is then rotated with respect to the rotating plates 52. Once the desired position is reached, the heads 66A of the locking pins 66 are released and the coil springs 68 bias the locking pins 66 back into the indexing holes 50 in the end plates 34. The final fixed position of truss frame 12 depends upon the location of the indexing holes 50. Once the locking pins 66 are inserted within the indexing holes 50, the truss frame 12 is locked in the rotated position. Preferably, the change in position of the truss frame 12 is accomplished while the truss assembly 10 is on the ground surface or when the truss assembly 10 is only slightly elevated above the ground surface although, the position of the truss frame 12 is able to be changed while the truss assembly 10 is in its final position elevated above the stage.

In the alternate embodiment, the truss frames 12 are connected together to form an extended truss assembly 10. In addition, the forked stands 78 are used to create a truss system 80 which surrounds an arena 86. Each truss assembly 10 which forms the sides of the truss system 80 are able to rotate independently similarly to the rotation of a single truss assembly 10. This allows different angles of light from each side of the truss system 80 onto the enclosed arena 86.

Numerous variations will occur to those skilled in the art. It is intended, therefore, that the foregoing descriptions be only illustrative of the present invention and that the present invention be limited only by the hereinafter appended claims.

We claim:

1. A truss for supporting electric lights which comprises:

(a) first rods extending parallel to a longitudinal axis of the truss each having spaced apart first and second ends perpendicular to the longitudinal axis of the truss so as to define a rectangular cross-section perpendicular to the longitudinal axis with four sides;

(b) second rods having spaced apart ends and extending between and perpendicular to two of the first rods to form a plurality of side-by-side openings along the length of the first rods wherein the openings are in a plane parallel to the longitudinal axis of the truss and provide a front side of the truss along one of the sides;

(c) a plurality of third rods extending diagonally between two of the first rods and the ends of the second rods across each of the remaining sides within planes parallel to the longitudinal axis of the truss and defined by each of the remaining sides of the truss;

(d) fourth rods mounted parallel to the longitudinal axis and in a plane along an uppermost one of the sides of the truss and wherein electric lights are secured inside of the truss at an intersection of the third rod and the fourth rod by a first fastening means adjacent each of the side-by-side openings on the front side of the truss; and (e) a pair of end plate means mounted on the first end and the second end of the first rods.

2. The truss of claim 1 wherein the rods and the end plate means are constructed of aluminum.

3. The truss of claim 1 wherein the end plate means is an end plate and corner plates wherein the end plate is secured to the corner plates by a securing means.

4. The truss of claim 1 wherein the first fastening means is a bolt through the fourth rod and a nut wherein a head of the bolt engages the third rod to prevent rotation and wherein the nut is provided on the bolt to secure the electric lights to the fourth rod.

5. The truss of claim 1 wherein between about 4 and 7 electric lights are provided across a span of the truss.

6. The truss of claim 1 wherein a support receiving means is mounted on the end plate means on a side opposite the first rods for supporting the truss in an elevated position with a support means.

7. A method for lighting an area with electric lights which comprises:

(a) providing a truss having a first end and a second end; a pair of end plate means on the first end and the second end of the truss; a rotatable plate means with two spaced apart sides adjacent to and on each of the end plate means so as to allow the truss to rotate about a longitudinal axis of the truss; a disengageable locking means mounted so as to engage the rotatable plate means and the end plate means to lock the truss in a desired position relative to the rotatable plate means with a front side of the truss facing a desired position; and a support receiving means mounted on the rotatable plate means on a side opposite the mounted end plate means for supporting the truss in an elevated position with a support means;

(b) mounting the truss assembly on a support means at each of the support receiving means; and (c) positioning the lights on the truss assembly so as to be directed at the area.

8. The method of claim 7 wherein the locking means is a pin which engages one of a series of holes in each of the end plate means and the rotatable plate means and wherein an angle of the truss relative to a ground level is adjusted by rotating the truss on the rotatable plate means.

9. The method of claim 7 wherein the truss assembly is rotated between each of the support receiving means on the rotatable plates by removing the pin from one of the series of holes in each of the end plate means and the rotatable plate means to adjust the angle of the truss and the electric lights relative to the area.

10. A method for lighting an area with electric lights which comprises:

(a) providing a truss assembly including: a truss having first rods extending parallel to a longitudinal axis of the truss each having spaced apart first and second ends perpendicular to the longitudinal axis of the truss so as to define a rectangular cross-section perpendicular to the longitudinal axis with four sides; second rods having spaced apart ends and extending between and perpendicular to two of the first rods to form a plurality of side-by-side openings along the length of the first rods wherein the openings are in a plane parallel to the longitudinal axis of the truss and provide a front side of the truss along one of the sides; a plurality of third rods extending diagonally between two of the first rods and the ends of the second rods across each of the remaining sides within planes parallel to the longitudinal axis of the truss and defined by each of the remaining sides of the truss; a pair of end plate means mounted on the first end and the second end of the first rods; a rotatable plate means with two spaced apart sides mounted adjacent to and on each of the end plate means so as to allow the truss to rotate about the longitudinal axis of the truss; a pair of disengageable locking means mounted so as to engage the rotatable plates and the end plate means to lock the truss in a desired position relative to the rotatable plate means with the front side of the truss facing a desired position; and a support receiving means mounted on the rotatable plate means on a side opposite the mounted end plate means for supporting the truss in an elevated position with a support means; and a fourth rod mounted parallel to the longitudinal axis in a plane along an uppermost one of the sides of the truss and wherein fastening means is provided at an intersection of the third rod and the fourth rod for securing lights inside of the truss adjacent each of the side-by-side openings of the truss;

(b) mounting the truss assembly on a support means at each of the support receiving means; and (c) positioning the lights on the truss assembly so as to be directed at the area.

11. The method of claim 10 wherein the locking means is a pin which engages one of a series of holes in each of the end plate means and the rotatable plate means and wherein an angle of the truss relative to a ground level is adjusted by rotating the truss on the rotatable plate means.

12. The method of claim 11 wherein a horizontal position of the lights is changed by moving the lights on the fastening means.

13. A method for lighting an area with electric lights which comprises:

(a) providing a truss for supporting electric lights which includes first rods extending parallel to a longitudinal axis of the truss each having spaced apart first and second ends perpendicular to the longitudinal axis of the truss so as to define a rectangular cross-section perpendicular to the longitudinal axis with four sides; second rods having spaced apart ends and extending between and perpendicular to two of the first rods to form a plurality of side-by-side openings along the length of the first rods wherein the openings are in a plane parallel to the longitudinal axis of the truss and provide a front side of the truss along one of the sides; a plurality of third rods extending diagonally between two of the first rods and the ends of the second rods across each of the remaining sides within planes parallel to the longitudinal axis of the truss and defined by each of the remaining sides of the truss; and a pair of end plate means mounted on the first end and the second end of the first rods;

(b) mounting the electric lights inside of the truss adjacent each of the side-by-side openings in the front side of the truss; and (c) positioning the truss with the electric lights adjacent the area so that the electric lights are directed toward the area.

14. A method for lighting an area with electric lights which comprises:

(a) providing at least one segment of a truss which includes first rods extending parallel to a longitudinal axis of the truss each having spaced apart first and second ends perpendicular to the longitudinal axis of the truss so as to define a rectangular cross-section perpendicular to the longitudinal axis with four sides; second rods having spaced apart ends and extending between and perpendicular to two of the first rods to form a plurality of side-by-side openings along the length of the first rods wherein the openings are in a plane parallel to the longitudinal axis of the truss and provide a front side of the truss along one of the sides; a plurality of third rods extending diagonally between two of the first rods and the ends of the second rods across each of the remaining sides within planes parallel to the longitudinal axis of the truss and defined by each of the remaining sides of the truss; a fourth rod mounted parallel to the longitudinal axis in a plane along an uppermost one of the sides of the truss; fastening means provided at an intersection of the third rod and the fourth rod for securing lights inside of the segment adjacent each of the side-by-side openings in the front side of the truss; a pair of end plate means mounted on the first end and the second end of the first rods; and a support receiving means mounted on the end plate means on a side opposite the first rods for supporting the truss in an elevated position with a support means;

(b) mounting the electric lights by the fastener means inside of the truss adjacent each of the side-by-side openings in the front side of the truss; and (c) positioning the truss with the electric lights adjacent the area so that the electric lights are directed toward the area.

* * * * *